US005507260A

United States Patent [19]

Hintzen

[11] Patent Number: 5,507,260

[45] Date of Patent: Apr. 16, 1996

[54] FUEL MANAGEMENT SYSTEM FOR INTERNAL COMBUSTION ENGINES

[76] Inventor: Mark N. Hintzen, 1421 Sierra Dr. NE., Apt. 4D, Cedar Rapids, Iowa 52402

[21] Appl. No.: 394,903

[22] Filed: Feb. 27, 1995

[51] Int. Cl.[6] ..... F02M 41/00; F02B 3/00

[52] U.S. Cl. ..... 123/299; 123/451

[58] Field of Search ..... 123/299, 300, 123/447, 451

[56] References Cited

U.S. PATENT DOCUMENTS

| | | | |
|---|---|---|---|
| 1,657,373 | 1/1928 | Danielsson | 123/451 |
| 3,085,559 | 4/1963 | Larbre | 123/300 |
| 4,392,466 | 7/1983 | Mowbray et al. | 123/299 |
| 4,462,369 | 7/1984 | Dazzi | 123/451 |
| 4,583,509 | 4/1986 | Schechter et al. | 123/451 |
| 4,691,674 | 9/1987 | Otsuka et al. | 123/299 |
| 4,700,672 | 10/1987 | Baguena | 123/299 |
| 5,090,378 | 2/1992 | Gonzalez | 123/300 |

*Primary Examiner*—Thomas N. Moulis
*Attorney, Agent, or Firm*—James C. Nemmers

[57] ABSTRACT

A fuel management system that separates the three-dimensional functions of fuel injection pressure, volume and timing and thus eliminates co-dimensional dependencies. The system of the invention utilizes volumetric injection control and is based on displacement of a predetermined volume rather than volume generated by flow due to pressure with respect to time, as in prior art systems. In one of its simplest configurations, the fuel management system combines a pair of "sister" injectors and a volumetric injection control assembly comprised of a simple displacement piston which free floats a given distance to deliver fuel alternately to each injector. When one injector's solenoid valve operates to activate it's main injection, it simultaneously loads the adjacent injector with a predetermined volume of fuel for the adjacent injector's main volume injection. Throttling fuel volume is controlled by controlling the length of the cylinder's barrel containing the free floating piston.

10 Claims, 4 Drawing Sheets

FUEL MANAGEMENT SYSTEM FOR INTERNAL COMBUSTION ENGINES

BACKGROUND OF THE INVENTION

In recent years, governments have adopted emission standards for internal combustion engines which standards require lessening of harmful emissions from internal combustion engines. Initially, these standards were imposed upon gasoline fueled engines, and more recently standards are being adopted for diesel engines. Because of their durability and high power output, diesel engines are firmly established as the engine of choice in the trucking and off-the-road industries. There are over 150,000,000 diesel engines currently in operation worldwide, with over 10,000,000 new engines entering the market each year. In anticipation of these new standards which require reduced emissions, diesel engine manufacturers are developing and modifying the existing fuel management systems. With the next generation of engines utilizing radical changes in design not anticipated to be available until at least the year 2000, the only practical approach to meeting fuel emission standards without the sacrifice of fuel economy will have to be improvements in the existing designs of fuel management systems. At the present time, changes to the fuel management systems designed to meet the emissions requirements will add considerably to the cost of the engines or reduce fuel efficiency, or both. This is primarily because efforts to reduce emissions have been directed toward adding on to, or modifying, existing fuel system designs by incorporating higher precision pressure components and faster timing control devices. These efforts are directed specifically to control only one of the several factors of emissions—fuel volume efficiency.

However, when higher pressure is used to improve and control emissions, the precise pressure devices become very costly, and within some design configurations, become impractical and/or volume control efficiency is sacrificed. This is because known designs are co-dimensional in actual design concept and function. In other words, fuel pressure, timing and fuel volume are all interdependent and interrelated in the current designs. Moreover, there are practical limitations on engines with regard to pressure and timing when prior art fuel management systems are employed. Therefore, in part, attempts to modify and improve existing engine designs are restricted. This is because the over-all engine investment increases the need to improve the current fuel management systems.

There is therefore a need for technological improvements that will meet emission control standards, without change to existing basic engine designs, or without sacrifice of fuel volume efficiency.

All current designs of diesel engines utilize fuel-injection systems to meet the fuel metering requirements of the engine. These fuel injection systems include a variety of mechanical and electrical configurations designed to meter fuel to each cylinder in the most efficient manner. In most systems, mechanical components make up the greater cost, with electronic components being the least expensive to manufacture.

The mechanical components of a fuel management system are divided into two main groups, the low pressure components and the high pressure components.

The low pressure components consist generally of the fuel tank, fuel filter, fuel supply pump and/or lift pump. These low pressure components utilize standard precision parts, and in today's designs are generally acceptable from both a cost effectiveness and efficiency standpoint. At the current state of the art, even with modest increases in efficiency to the low pressure components, very little overall system efficiency is gained.

The components that make up the high pressure group include the injection pump, injector supply rail, overflow valves, high speed solenoid valves and injectors. These high pressure components have high precision and high reliability by design. Thus, these components represent a substantial part of the manufacturing cost of a fuel management system. Unlike the low pressure components, a small increase in efficiency in any one of the high pressure components can gain a modest increase in overall fuel management system efficiency.

Both the high pressure and low pressure components of the fuel system are integrated into the supply and return lines and are interfaced with the electrical monitoring devices through an electronic control module or "ECM". The function of the control module is to receive inputs from the engine and the operator and produce output commands to the controllable components of the fuel injection system.

The speed, reliability and cost of the primary electrical components far exceed the speed, .reliability and cost of the secondary electronic components or any part of the mechanical components of a fuel management system. In general, primary electrical components of a fuel injection system for current diesel engine designs, like the electronic control module, are adequate. However, the secondary electrical components, such as the electronically controlled solenoids within the high pressure group, are currently being upgraded in order to meet the co-dimensional demands. These electronically controlled solenoids are an integral part of the fuel injectors and the need for faster acting and lower power solenoids are necessary to improve performance and lower emissions.

Because of the co-dimensional dependencies of fuel pressure, volume and timing in current fuel management systems, most of the efforts to meet emission standards have been directed to both the mechanical and electrical components in the high pressure group. In recent years most of the improvements involved the co-dimensional relationship between timing and pressure, higher precision manufactured components, and faster acting solenoid valves, all of which resulted in small advancements in the fuel management systems for the diesel industry.

As an example of prior art improvements in fuel management systems, some such systems use a cam lobe, integral with the existing mechanical valve cam located on top of the engine. This cam lobe activates a plunger in the injector for producing the necessary pressure of injection. The injection pressure in such systems is controlled by the profile and the velocity of the cam lobe that drives a plunger downwardly through a cylinder inside the injector. The cam lobe forces the injector's plunger to travel the full injector stroke, thereby dispensing the full volume of the injector's cylinder during each injector cycle, with fuel constantly being internally bled off to the fuel tank through the solenoid valve. The precise timing of the injection is initiated by energizing the solenoid valve, thereby directing the fuel towards the injection nozzle instead of the tank, with fuel metering being produced by precisely timing the moment the solenoid is de-energized.

In these prior art systems, injection pressure is thus controlled by the leverage and speed of the cam profile at the time of injection and the internal size of the injector nozzle, while the volume of fuel injected is controlled by varying the "on-time" of the solenoid valve. As is true with other prior art systems, this system is co-dimensional, and thus the timing of the solenoid verses the cam profile and engine speed has to be precise to control the fuel metering.

Changing the timing of the injection also changes the point on the cam where injection occurs, and a given solenoid valve's "on-time" will result in a different amount of fuel delivered. This requires that different control values be programmed into the control module to compensate for timing, resulting in an "averaging" of the fuel metering. Moreover, when cam velocity changes, the rate of fuel forced through the injector nozzle changes, which also changes pressure in the nozzle, and thus injection pressure also becomes co-dimensional with timing and engine speed. Fuel volume efficiency is sacrificed due to injection variations caused by imperfect repeatability of the cam lobe, the control solenoids, and the control modules compensating for timing.

Other prior art systems use a high pressure common rail with a high pressure piston-rotary cam style pump that feeds high pressure fuel to the common fuel rail for storage prior to the injection event. Each fuel injector is connected to the common rail through a solenoid which, in conjunction with the control module, controls the injection timing and fuel volume.

Internally, the injector has a needle spool valve that is under high pressure on one end, and is activated when the opening of the solenoid valve creates an imbalance in pressure at the top of the needle, thus lifting the needle and allowing high pressure to flow through the nozzle chamber and into the engine.

The volume of fuel injected with this system depends on the stored high pressure and precise timing, and thus this system is co-dimensional. When higher pressure is required in order to reduce emissions, high pressure waves (Helmoltz resonance) occur throughout the high pressure components causing fuel metering problems, and precision fuel delivery is thus sacrificed in order to control emissions. Additional components and fuel metering "averaging" is added to the fuel management system to compensate for these high pressure waves. Moreover, high pressures and the high pressure waves subject the parts of the fuel system to design and durability problems.

During normal operation of a fuel injected engine, the same volume of fuel is not injected into all cylinders due to imbalances in the system and the co-dimensional dependencies that exist. This condition is evidenced at slow idle by a roughness in engine speed. At higher throttle settings this imbalance in delivery is evident as a loss of fuel efficiency. "Averaging" is the fuel system designers way of estimating composite fuel delivery to the entire engine. Injection timing and other parameters are therefore based on the average fuel delivered to each cylinder rather than the actual delivery rate on a cylinder to cylinder basis. Using this "averaging" principle, there is a known popular style of injection system which features a mechanical or electronic governor actuator pump that has an integral timing device dedicated to each of the pump's plungers which are mated to a specific injector. The pump generates the necessary pressure and distributes the fuel to the individual injectors, while a mechanical control collar or electric solenoid controls the quantity of the fuel that is injected. The metered fuel is "averaged" by means of the pump's governor mechanism, either mechanically or electrically. Fuel timing and injection pressure are controlled by the same piston's volume chamber, and prior to injection the rotation of the pump is matched with the rotation of the engine. Therefore, this system is also co-dimensional.

In all of these mechanical control systems of the prior art, many components must be manufactured to precise tolerances, while in the electrical/mechanical systems, fuel "averaging" is used to control actual metered fuel. Fuel volume efficiency is sacrificed due to timing variations of the electrically controlled governor.

Another prior art system utilizes a "medium" pressure fuel rail which pressure is then intensified in the injector. The solenoid for each injector is activated to enable medium pressure fuel to flow from the supply rail to the top of an intensifier piston in the injector. With an area difference between the top and the bottom of the intensified piston, pressure is increased and medium pressure fuel is intensified into high pressure fuel. This high pressure intensified fuel then flows through a check valve into a nozzle chamber and into the engine. Fuel metering is controlled by varying the "on time" of a solenoid that passes fuel into the top or medium pressure side of the intensifier piston. By using intensified injection, very few components are under high pressure. However, the system is, like all prior art systems, co-dimensional.

With all of the foregoing described prior art systems, the industry trend, in summary, is towards higher injection pressure of the fuel into the engine's piston chamber in order to meet future emissions standards. The problem with increasing the injection pressure, is that with a co-dimensional injection system, volume efficiency is sacrifice.

The primary emphasis of the industry is to improve, by redesign and increased cost, the components that depend directly on pressure and timing to control volume. Fuel "averaging" is the trend established by the industry to overcome most of the co-dimensional dependencies. This in itself is netting less then the desired fuel volume efficiency.

Moreover, additional fuel saving techniques like pilot injection, injection rate shaping, and inlet swirl become a secondary emphasis for fuel management systems.

There is therefore a need for a fuel management system that can utilize the best available components of current designs, while having the flexibility of adding fuel saving features that are currently known to improve emission standards without "averaging" and sacrificing fuel volume efficiency.

SUMMARY OF THE INVENTION

When used in the description of the invention, the following terms have the indicated meaning:

"Low fuel pressure" is the fuel pressure produced by the fuel tank pump that is applied to the input of the variable pressure main injection pump. This fuel pressure usually is in the 50–120 psi range and is used simply to move fuel from the tank to the high pressure pump.

"Medium fuel pressure" is the fuel pressure produced by the variable pressure main injection pump. This fuel pressure constitutes the force that ultimately produces the pressure of injection and varies generally within the range of 1500–3500 psi in a developed system. This medium fuel pressure is applied to the lower pressure or larger surface area side of an intensifier piston that is integral to an injector body.

"High fuel pressure" is the fuel pressure that is present at the injector nozzle and is directly proportional to the fuel pressure at the top of the intensifier. This high fuel pressure varies depending on atomization requirements for desired engine operating parameters will normally vary in the range of 12,000–27,000 psi.

"VIC" is an acronym for "Volumetric Injection Control" assembly and refers to the invention's free floating piston assembly that is common to all configurations and applications of the invention. The "VIC" can be a separate assembly or can be integral with an injector or variable pressure pump. The "VIC" assembly can also have a separate pilot injection, free floating piston co-located as part of the assembly. However, this pilot "VIC" can also be located in a different assembly.

"UNIVIC" is an acronym for a "Universal Volumetric Injection Control" assembly and refers to a "VIC" assembly that incorporates it's own valving and is configured to work with a multiple of two cylinders as in a "V" type of diesel engine. As is true with the basic "VIC" assembly, the "UNIVIC" assembly may have a separate pilot injection piston co-located in the same assembly or it may be mounted separately or integrally as a part of a variable pressure pump or intake manifold, cylinder head, etc.

In the invention, a fuel management system incorporating the principles of the invention separates the three-dimensional functions of fuel injection pressure, volume and timing and thus eliminates co-dimensional dependencies. The system of the invention utilizes volumetric injection control and is based on displacement of a predetermined volume rather than volume generated by flow due to pressure with respect to time, as in prior art systems.

The system of the invention in one of its simplest configurations combines a pair of "sister" injectors and a "VIC" assembly comprised of a simple displacement piston which free floats a given distance to deliver fuel alternately to each injector. In general, when one injector's solenoid valve operates to activate it's main injection, it simultaneously loads the adjacent injector with a predetermined volume of fuel for the adjacent injector's main volume injection. Throttling fuel volume is controlled by controlling the length of the cylinder's barrel containing the free floating piston.

Since the system is based upon a displacement concept for volume control, the piston does not have to be maintained at constant pressure or travel at a precise time for exact volume control. This separates the three dimensions of pressure, volume and timing into independent controllable functions of the fuel management system.

In another configuration of the invention, one "UNIVIC" assembly is used to meter fuel to, for example, alternating sets of injector fuel chambers while the injector control solenoid valve of the "next to be filled" injector is activated to accept fuel directed to it's chamber.

BRIEF DESCRIPTION OF THE DRAWINGS

FIG. 4 is actually composed of three complete injector units A, B and C, each of the type represented in FIGS. 1, 2, and 3.

DESCRIPTION OF THE PREFERRED EMBODIMENTS OF THE INVENTION

Figure 1:
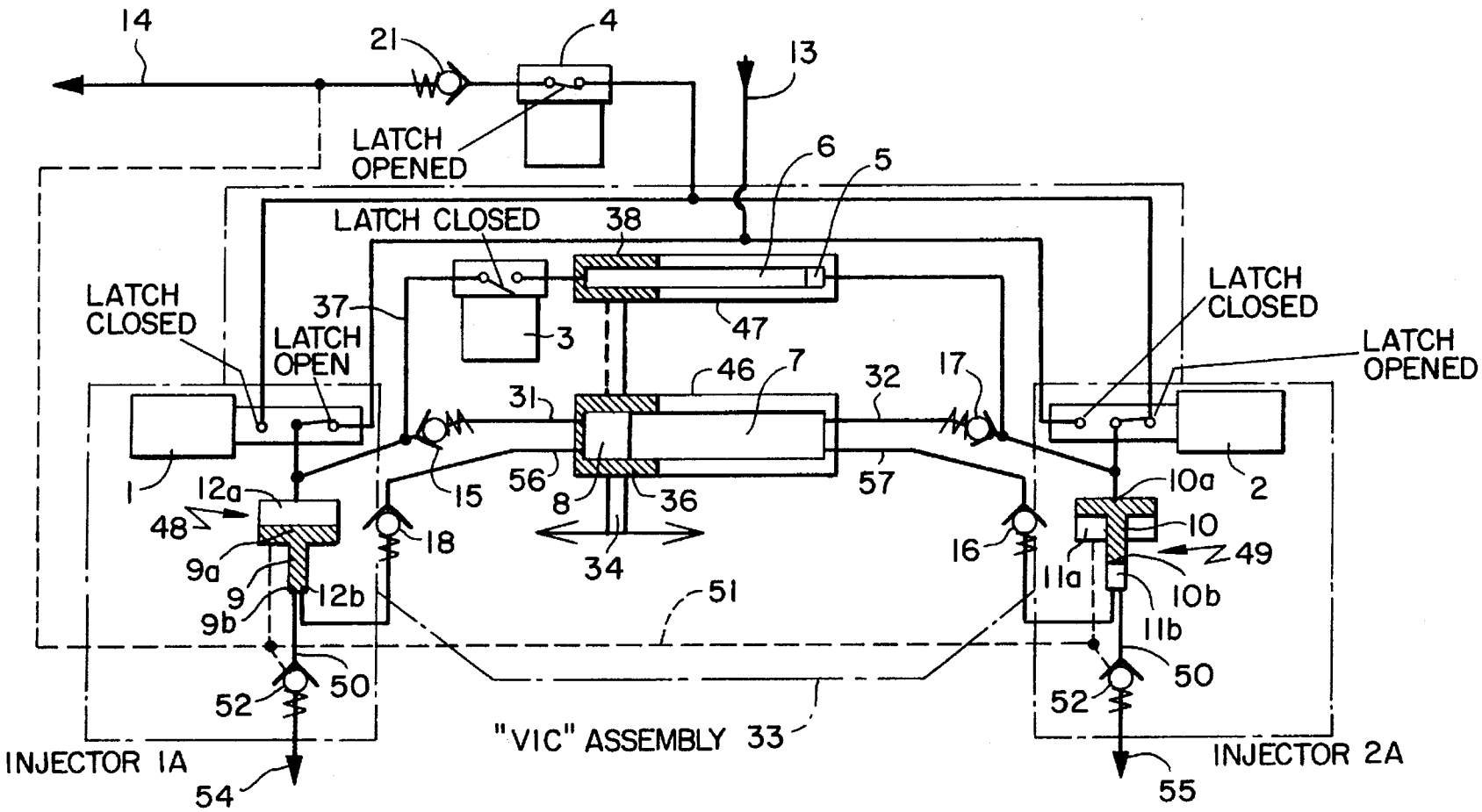
FIG. 1 is a fuel schematic diagram showing the basic principles of the invention in its simplest form as it would be configured with pilot injection between two cylinders of an engine.
Figure 2:
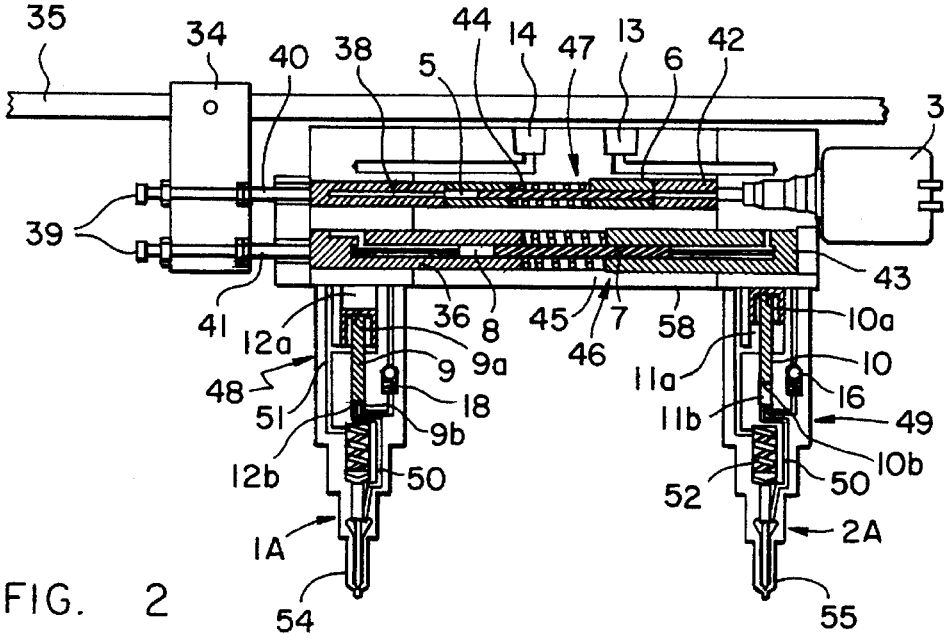
FIG. 2 is a longitudinal cross sectional view of an injector unit incorporating the principles of the invention with main and pilot injection capability and is a mechanical representation of FIG. 1.
Figure 3:
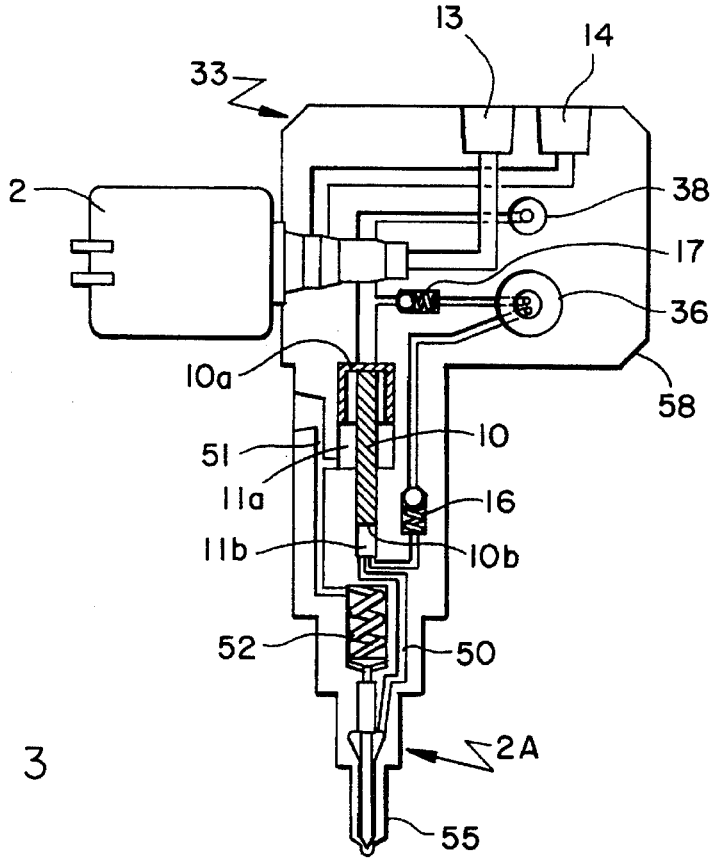
FIG. 3 is a side elevational view, partly in section, of the injector unit of FIG. 2 showing one method of internal flow and showing the fuel flow to an intensified fuel injector and injector nozzle.
Figure 4:
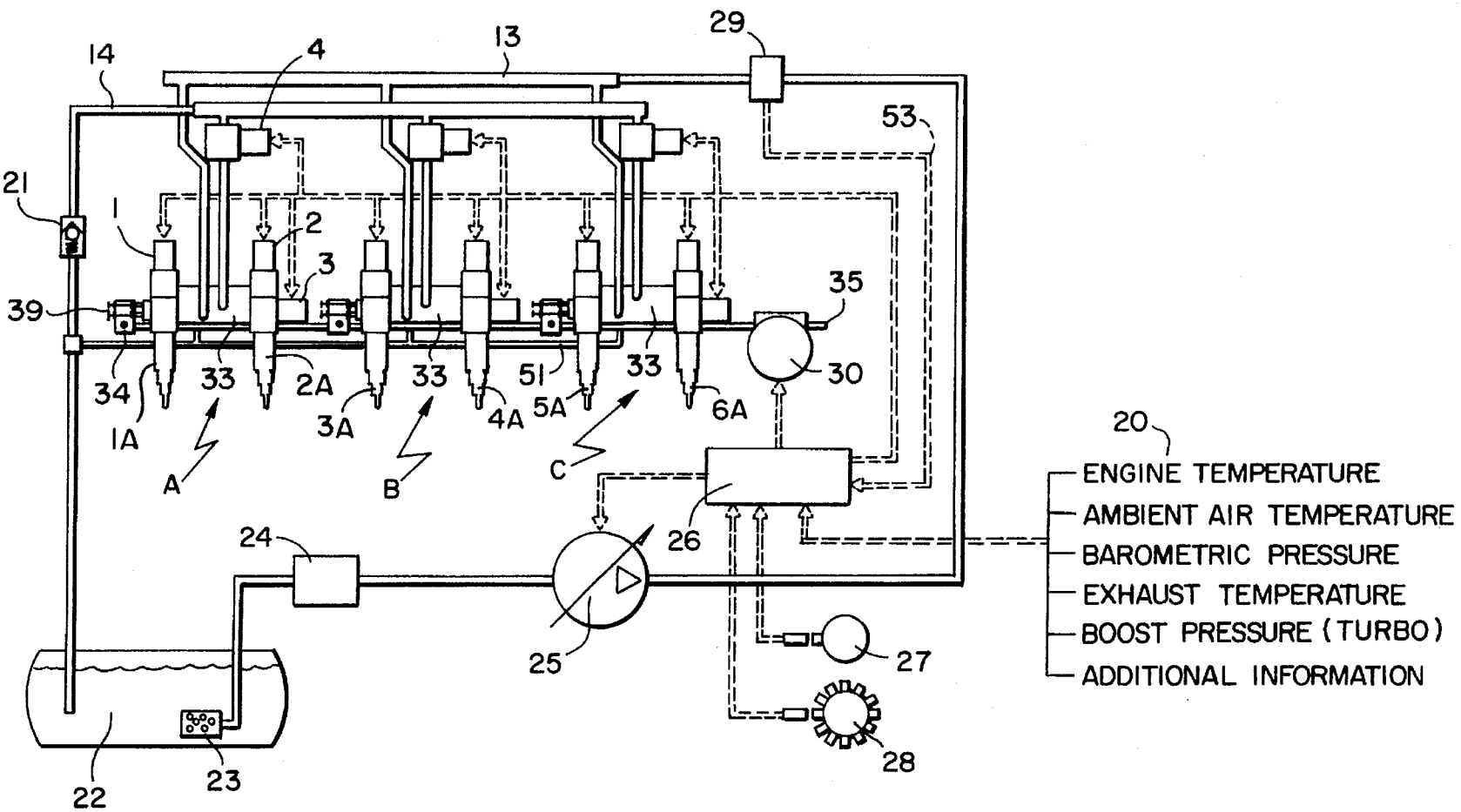
FIG. 4 is a fuel management system diagram drawn using conventional fluidics/mechanical symbols and represents the application of the invention in a six cylinder in-line diesel engine.

FIGS. 1, 2 and 3 illustrate the preferred embodiment in which a single "VIC" assembly 33 is shared with and operates two intensified injectors 1A and 2A. FIG. 1 is the primary diagram for explaining the principles of operation of the invention since it shows the schematic of an intensified injector 1A combined with an intensified injector 2A and a "VIC" assembly 33 all of which form a complete "VIC" injector unit A, B or C (see FIGS. 4 and 5). In FIG. 1, items such as a fuel tank, lift pump, fuel filter, electronic controller, common fuel rail, etc. are omitted for ease of explanation, but these standard components of a fuel system are illustrated in FIG. 4.

Referring now to FIGS. 1, 2 and 3, each of the injectors 1A and 2A has an intensifier assembly indicated generally by the reference numerals 48 and 49, respectively, and a nozzle 54 or 55. The intensifier assemblies 48 and 49 include intensifier pistons 9 and 10, respectively, which have upper portions 9*a* and 10*a* moveable in upper chambers 12*a* and 11*a* and lower portions 9*b* and 10*b* moveable in lower chambers 12*b* and 11*b*. The top surface areas of the upper portions 9*a* and 10*a* are substantially greater than the bottom surface areas of the lower portions 9*b* and 10*b*.

Also included as a part of a "VIC" assembly 33 are check valves 15, 16, 17 and 18. Check valve 15 is in line 31 leading from the upper chamber 12*a* of intensifier assembly 48 to the main VIC injector unit 46, while check valve 18 controls the direction of flow through line 56 from the lower chamber 12*b* to the main VIC injector unit 46. Check valve 17 is similar to valve 15 in that it controls the direction of flow in line 32 connecting the main VIC injector unit 46 with the upper chamber 11*a* of intensifier assembly 49, while valve 16 is in the line 57 from the main VIC injector unit 46 to the lower chamber 11*b*.

The "VIC" assembly 33 provides both the main VIC injection unit 46 and VIC pilot injection unit 47 for each pair of cylinders of the engine. As is best seen in FIGS. 2 and 3, the body section 58 of the VIC assembly 33 contains the main moveable barrel 36, which is moveable relative to the body section 58 against the resistance of spring 45, and the fixed main barrel 43. Barrels 36 and 43 form a part of the main VIC injection unit 46 and have a longitudinal chamber 8 in which a free-floating piston 7 moves from end to end relative to the barrels 36 and 43. Body section 58 also contains the pilot moveable barrel 38, which is moveable relative to the body section 58 against the resistance of spring 44, and the fixed pilot barrel 42. Barrels 38 and 42 form a part of the pilot VIC injection unit 47. Similar to the main VIC injection unit 46, moveable pilot barrel 38 and fixed pilot barrel 42 have a chamber 5 in which a piston 6 is free to float from end to end relative to the barrels 38 and 42. The moveable main barrel 36 and the moveable pilot barrel 38 are coupled by plunger pins 41 and 40 to an adapter 34 which is connected to a throttle linkage rod 35 interconnecting the adjacent "VIC" assemblies, movement of the rod 35 being controlled by a throttle servo control motor 30 (FIG. 4). Adjustment screws 39 in the adapter 34 provide for adjustment of the position of the moveable barrels 36 and 38 relative to the fixed barrels 43 and 42 and relative to the interconnecting adjacent VIC assembly 33.

The described components of the "VIC" assembly 33 provide for control of the throttle or total fuel volume that flows into the chambers 8 and 5 of the main injector unit 46 and pilot injector unit 47, respectively. Since the moveable pilot barrel 38 is part of the same assembly as the moveable main barrel 36 and because they are connected together by adaptor 34, the pilot injection volume in chamber 5 is always a controlled ratio relative to the main injection volume in chamber 8. It should be understood, however, that the "VIC" assembly 33 can be designed so that the ratio of pilot to main inject volume changes with throttle position.

FIGS. 2 and 3 show the mechanical and physical construction of an entire "VIC" injector unit that is shown schematically in FIG. 1.

FIG. 4 shows a fuel management system representing the application of the invention in a six cylinder in-line diesel engine. In the system of FIG. 4, three complete "VIC" injector units A, B and C, each of the type represented in FIGS. 1, 2, and 3 are shown together with a fuel tank 22 from which fuel is pumped by a variable pressure pump 25 through the fuel supply line 23 which contains a fuel filter 24. Fuel discharged from pump 25 flows through the main fuel supply line 13 to the three "VIC" assemblies 33, there being one "VIC" assembly 33 for each pair of engine cylinders. An engine speed and valve cam angle sensor 28 and an injection pressure sensor 29 in fuel supply line 13 continuously deliver their values to an electronic control module (ECM) 26. ECM 26 also receives additional information from sensors 20, which provide engine and exhaust temperatures, ambient air temperature and pressure, etc. In addition, the accelerator pedal 27 communicates the vehicle operator selected speed to the ECM 26 through wiring harness 53. The control module 26 acts on this information to appropriately control the pressure of the fuel pump 25, control the throttle servo control motor 30, and the timing of all solenoid valve coils associated with the solenoid valves of each "VIC" injector unit.

For the purpose of explaining the operation of the invention, all the electrically controlled solenoids in FIG. 1 are either "latched open" for the passing of fuel or "latched closed" for the blocking of fuel. For example, in the schematic of FIG. 1, solenoid valve 1 and solenoid valve 2 that form a part of injectors 1A and 2A, respectively, are always in opposite operating positions prior to a pilot or main injection occurrence. Thus, when one solenoid valve is open to the fuel supply line 13, the adjacent "sister" solenoid valve is open to fuel vent line 14. As shown in the timing diagram of FIG. 5, activation of solenoid valve 1 and solenoid valve 2 do not have to occur simultaneously for proper operation.

Figure 5:
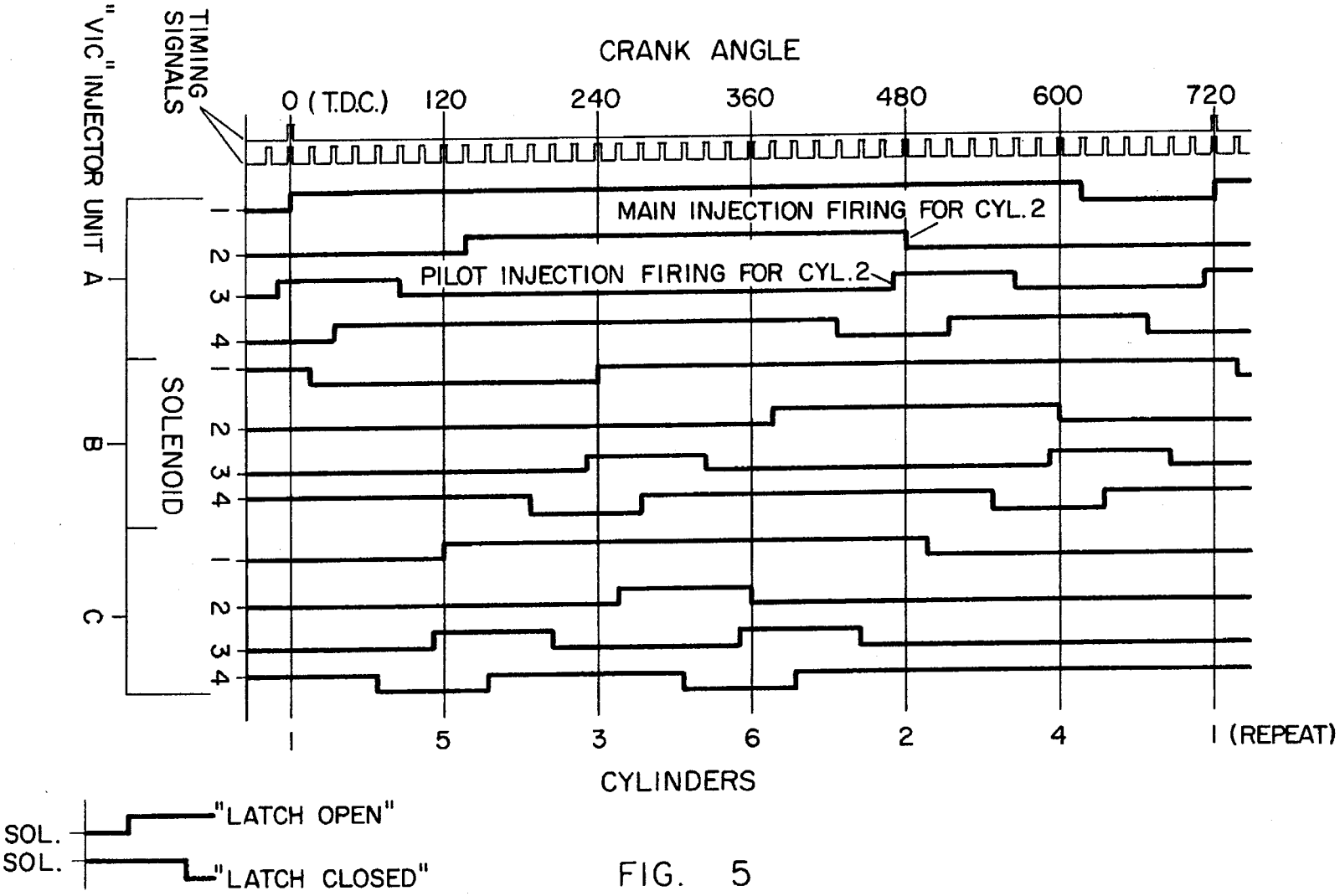
FIG. 5 is a timing diagram illustrating the sequence of solenoid events that would occur for a 4-stroke, six cylinder diesel engine by crank angle and using the configurations of the invention.

Similarly, solenoid valve 4 in the fuel vent line 14 and solenoid valve 3 in fuel line 37 connecting the chamber 5 of the pilot VIC injection unit 46 with intensifier 48 are also always in opposite operating positions in the schematic of FIG. 1, and depending upon activation of pilot injection, operate in conjunction with solenoid valve 1 and solenoid valve 2. Again, as shown in FIG. 5, timing between solenoid valve 3 and solenoid valve 4 does not have to be exact although the sequence is always the same for proper operation. This flexibility in application illustrates that two solenoids can either be activated by the same coil or by the same control wire from the control module.

Referring now to the diagram of FIG. 5, there is shown a crank angle timing diagram for a 6-cylinder, 4-stroke diesel engine in which three "VIC" injector units A, B and C have been installed. The injection sequence for "VIC" injector A will be described with reference to FIG. 5. Pilot injection of injector 2A is the first event in the sequence of operations to occur. Pilot injection of injector 2A requires that solenoid valve 4 block fuel flow prior to fuel passing through solenoid valve 3, and that medium pressure fuel be present in fuel line 37 when medium pressure is applied through solenoid valve 1 and into intensifier piston chamber 12.

To start pilot injection on injector 2A, solenoid valve 4 must close prior to the time of pilot injection so as to block fuel flow to the fuel vent line 14. At the time for pilot injection, solenoid 3 opens, allowing medium pressure fuel to force the pilot injection piston 6 toward injector 2A forcing the fuel in chamber 5 and thereby pushing intensifier piston 10 down a distance that the total volume in chamber 5 will allow, creating a metered pilot injection.

Moreover, since the main injection piston 7 still has the medium pressure present in chamber 8, the main injection piston 7 will not move when pilot injection occurs in injector 2A.

Due to the area difference between the top and bottom of the intensifier piston 10, high pressure pilot injection will develop and move through injector nozzle fuel line 50. This high pressure fuel will lift the nozzle lift check valve 52 and enter the engine's cylinder chamber, thus completing the pilot injection.

For the main injection of injector 2A, solenoid valve 2 latches closed, as seen in FIG. 1 and FIG. 5 and the top of piston 10 is exposed to the medium pressure supply causing main injection on injector 2A. The balance of the fuel remaining in chamber 11*b* after pilot injection is then forced out through injector nozzle line 50 at high pressure and out through the nozzle lift check valve 52 for injection into the engine's cylinder chamber.

Again, since the pilot injection piston 6 still has the medium pressure present through solenoid 3, the pilot injection piston 6 will not move when main injection occurs on injector 2A. Similarly, since the main injection piston 7 still has the medium pressure present through solenoid 1, the main injection piston 7 will not move when main injection occurs on injector 2A.

Since medium fuel pressure from supply line 13 is present in chamber 12*a* at the top of intensifier piston 9, this same pressure will force fuel through check valve 15 in line 31 leading to the main VIC injector unit 46 and force the main volume piston 7 to the position shown (to the right in FIG. 1). When the fuel volume of the chamber 8 of the main VIC injector unit 46 is dispensed by piston 7 moving to the right (FIG. 1), the fuel will enter only chamber 11*b* of the intensifier assembly 49 due to the resistance of the nozzle lift check valve 52 and the allowance of the internal venting line 51, and with solenoid valve 4 latched open, fuel will be vented from the top of piston 10*a*. With solenoid valve 3 latched closed, the pilot injection piston 6 will not dispense the fuel in the chamber 5 of the pilot VIC injection unit 47. However, because the volume in chamber 8 of the main VIC injection unit 46 is equal to the volume that was present on the other side of the piston 7 prior to the occurrence of main injection from injector 1A, a volume of fuel equal to the volume of chamber 8 is forced through check valve 16 in fuel line 57 leading to the intensifier assembly 49 of injector unit 2A. This precise volume of fuel flows into chamber **11*b* of the intensifier unit 49 below intensifier piston 10. As chamber 11*b* fills with fuel, intensifier piston 10 moves upward venting the fuel in chamber 11 above intensifier piston 10 through solenoid valve 2 and solenoid valve 4 to the fuel vent line 14 which returns it to the fuel tank 22 (see FIG. 4**).

It should be noted that the intensifier piston 10 will travel upward only the distance required to receive the measured volume from the main VIC injector unit 46 when piston 7 moves to the right.

Just after the main injection on injector 2A, and prior to the main volume fill of injector 1A, solenoid valve 3 and solenoid valve 4 will be returned to their pre-pilot starting position, as illustrated in the timing diagram, FIG. 5.

The medium pressure fuel is supplied to injector 1A from the common fuel supply line 13. The solenoid valve 1 of injector 1A is shown in FIG. 1 in the state that permits flow from the fuel supply line 13 into the chamber **12*a* of the intensifier assembly 48 above the intensifier piston 9. Therefore, the intensifier piston 9 will be in the down position just after fuel supplied from the main VIC injector unit 46 is discharged from the nozzle 54 of injector 1A**.

Just after the main injection on injector 2A, and the reset of solenoid valve 3 and solenoid valve 4, solenoid valve 1 latches closed to allow relief flow to the fuel vent line 14, allowing the main injection piston 7 to move toward injector 1A thus forcing the volume of fuel in chamber 8 through check valve 18 into the chamber **12*b* beneath piston 9 in injector 1A. Continuing through the timing sequence, with injector 1A now loaded with the metered amount of fuel, and the pilot injection piston 6 awaiting the latching open again of solenoid valve 3 to pilot inject injector 1A, injector 1A is now ready for it's control command to activate both the pilot and main injection as illustrated in FIG. 5**.

To start pilot injection on injector 1A, solenoid valve 4 must close prior to the time of pilot injection so as to block fuel flow to the fuel vent line 14. At the time for pilot injection, solenoid 3 opens, allowing medium pressure fuel to force the pilot injection piston 6 toward injector 1A forcing the fuel in chamber 5 and thereby pushing intensifier piston 9 down a distance that the total volume in chamber 5 will allow, creating a metered pilot injection. Moreover, since the main injection piston 7 still has the medium pressure present in chamber 8, the main injection piston 7 will not move when pilot injection occurs in injector 1A.

Due to the area difference between the top and bottom of the intensifier piston 9, high pressure pilot injection will develop and move through injector nozzle fuel line 50 of injector 1A. This high pressure fuel will lift the nozzle lift check valve 52 and enter the engine's cylinder chamber, thus completing the pilot injection.

With solenoid valve 1 of injector 1A latched open and fuel flowing into the chamber **12*a* of the intensifier assembly 48 of the injector 1A, main injection of injector 1A will then occur. In the state illustrated in FIG. 1, solenoid valve 2 of injector 2A is latched open which has vented the fuel from the top of piston 10 into the fuel vent line 14. Injector 2A will then be filled with the predetermined volume of fuel as controlled by main injector piston 7**.

This action of shuttling the fuel with prefill of an injector first, pilot injection second and then the main injection third, continues in a reciprocal manner alternately between the two injectors within each "VIC" injector unit on an engine as illustrated in the timing diagram, FIG. 5.

For the purpose of describing the principles of operation, FIG. 1 is shown in the operational sequence that shows injector 1A injection complete, and the foregoing illustrates that at the same time main injection occurs from injector 1A, a precise amount of fuel is volumetrically metered into the opposing injector 2A. Upon the next set of commands, and according to the timing diagram of FIG. 5, injection, first pilot and then main, of fuel from injector 2A will occur.

In any stage of operation, timing precision is dependent only on a solenoid entering a certain state and not on the amount of time the solenoid has to remain in that particular state. This flexibility in the design eliminates "field stabilization" considerations in the solenoid cores and armatures.

It should also be noted that there are other possible methods of changing or controlling the total movement or travel of the moveable barrels 36 and 38 and the main injection piston 6 and pilot injection piston 7. One other possible method is not to use a moveable barrel but instead fix the barrel or cylinder position and use a threaded screw inserted through the end of the barrel to limit the travel of the reciprocating piston.

As previously indicated, most fuel injection systems for diesel engines are controlled by an electronic control module 26, or ECM. In FIG. 4 the sensors (not shown) for the engine, monitor ambient air temperature, barometric pressure, exhaust temperature, and the boost pressure of a turbo charger if used, the position of the accelerator pedal 27 and the engine speed sensor 28 and are linked directly to the electronic control module 26.

An additional feature of the invention is that the control module 26 can control a throttle servo control motor 30 or mechanical linkage which controls the position of the moveable barrels 36 and 38 of the "VIC" assembly 33 through a control linkage 35, in a direct linear control thus assuring positive, accurate and balanced fuel delivery to all cylinders under all conditions. Moreover, with the system of the invention, once the control dimensions are isolated from each other, there are many possibilities of control through the control module 26 that can be readily utilized by persons skilled in the art. The fuel injection system of the invention achieves the accurate control of volume of the main injection, the accurate control of volume of the pilot injection, both independent of system pressure or timing, with the pilot injection and main injection operating independently of each other.

The system also has the capability of increasing the main injection pressure, rate shaping of the injection pulse and optimal utilization of the control module while maintaining exact volume control for total system efficiency. The system of the invention can be applied to existing fuel injection management systems of various types at a reasonable cost.

The basic unit of the invention is adaptable with any style injector although it is designed primarily to work with an intensified injection system, thus allowing the "VIC" components to operate in a medium pressure zone and take full advantage of low critical part tolerances of the fuel management system. Moreover, using intensified injection along with "VIC" components conserves total system energy between the medium pressure zone and the high pressure zone.

Also, where applicable, the invention allows a single "VIC" assembly of the invention to control fuel volume to more than two cylinders, thus reducing cost on engines with large numbers of cylinders. Thus, although the invention has been illustrated in connection with an injection unit for each two injectors of a four, six or eight cylinder system, obviously, a single "VIC" injector unit containing both main and pilot injection assemblies can be utilized to control all cylinders for a V-8 engine when the reciprocal action is applied to opposing banks of four cylinders each. In such a configuration, the "VIC" control solenoids shuttle fuel from the main piston-barrel assembly while each injector solenoid activates "open", by timing, thus receiving the predetermined volume of fuel. Moreover, the pilot control solenoid shuttles fuel from the pilot piston-barrel assembly while each injector's solenoid, by timing, is activated for the pre-determine pilot injection. And again, by timing, each injector's solenoid is activated allowing intensified pressure to inject a pre-determined non-pressure dependent fuel volume into the engine's cylinder chamber.

Using the principles of the invention, fuel volume, timing and pressure are totally independent functions as used in the "VIC" or "UNIVIC" configurations. Therefore, secondary features for diesel fuel management systems become not only feasible but practical as well. For example, the system of the invention makes precise control of pilot injection practical utilizing the same volumetric principle. With both the pilot and main injection using the piston-barrel concept, only the volume of fuel to be injected later enters the injector, resulting in total system conservation of energy.

Having thus described the invention in connection with preferred embodiments thereof, it will be evident to those skilled in the art that various revisions and modifications can be made to the preferred embodiments described herein without departing from the spirit and scope of the invention. It is my intention however that all such revisions and modifications that are obvious to those skilled in the art will be included within the scope of the following claims.

What is claimed is as follows:

1. A fuel management system for internal combustion engines having at least one pair of fuel injectors supplied with fuel under pressure from a fuel source through a fuel supply line and having a fuel vent line for returning fuel from the injectors to the fuel source, said system comprising a main injection unit operatively connected to each of said fuel injectors to supply fuel to said injectors, said main injection unit having a chamber extending along an axis from one end of the unit to another end of the unit for receiving fuel under pressure from said fuel supply line, a main fuel line connecting the chamber of the main injection unit to the fuel supply line, a main injection piston having a first side and a second side axially moveable within the chamber from one end of the chamber to the other end of the chamber, the main injection piston being freely moveable within the chamber according to fuel pressure applied to one of the sides of the main injection piston, the volume of the chamber not occupied by the main injection piston defining a predetermined volume of fuel to be introduced into one or the other of the fuel injectors, a first fuel line connecting the one end of the chamber of the main injection unit to one of the fuel injectors and a second fuel line connecting the other end of the chamber of the main injection unit to the other fuel injector, and valve means controlling the fuel flow within the system so that the predetermined volume of fuel is introduced first into one of the injectors when the main injection piston moves to one end of the chamber and then a predetermined volume of fuel is introduced into the other of the injectors when the main injection piston moves to the other end of the chamber.

2. The fuel management system of claim 1 in which the fuel injectors each have an intensifier assembly, each intensifier assembly having an upper chamber and a lower chamber, the upper chamber being of greater diameter than the lower chamber, an intensifier piston having an upper portion moveable in said upper chamber and a lower portion moveable in said lower chamber, the upper portion having a top surface of greater diameter than the bottom surface of the lower portion, the first fuel line connecting the one end of the chamber of the main injection unit to one of the fuel injectors connects to the lower chamber of the intensifier assembly below the bottom surface of the lower portion of the intensifier piston, and the second fuel line connecting the other end of the chamber of the main injection unit to other of the fuel injectors connects to the lower chamber of the intensifier assembly below the bottom surface of the lower portion of the intensifier piston, the upper chamber of the intensifier assembly of each of the fuel injectors being connected to the fuel supply line.

3. The fuel management system of claim 2 in which there is a pilot injection unit operatively connected to the intensifier assembly of each of said fuel injectors, said pilot injection unit having a chamber extending along an axis from one end of the pilot injection unit to another end of the pilot injection unit for receiving fuel under pressure from said fuel supply line, a pilot fuel line connecting the chamber of the pilot injection unit to the fuel supply line, a pilot injection piston having a first side and a second side axially moveable within the chamber from one end of the chamber to the other end of the chamber, the pilot injection piston being freely moveable within the chamber according to fuel pressure applied to one of the sides of the pilot injection piston, the volume of the chamber of the pilot injection unit not occupied by the pilot injection piston defining a predetermined volume of fuel to be introduced into the intensifier assembly of one or the other of the fuel injectors, a third fuel line connecting the one end of the chamber of the pilot injection unit to the intensifier assembly of one of the fuel injectors and a fourth fuel line connecting the other end of the chamber of the pilot injection unit to the intensifier assembly of the other fuel injector, and valve means controlling the fuel flow within the system so that the predetermined volume of fuel in the chamber of the pilot injection unit is introduced first into the upper chamber of the intensifier assembly of one of the injectors when the pilot injection piston moves to one end of the chamber and then the predetermined volume of fuel in the chamber of the pilot injection unit is introduced into the intensifier assembly of the other of the injectors when the pilot injection piston moves to the other end of the chamber of the pilot injection unit

4. The fuel management system of claim 3 in which the third fuel line connecting the one end of the chamber of the pilot injection unit to the intensifier assembly of one of the fuel injectors connects to the upper chamber of the intensifier assembly, and the fourth fuel line connecting the other end of the chamber of the pilot injection unit to the intensifier assembly of the other one of the fuel injectors connects to the upper chamber of the intensifier assembly.

5. The fuel management system of claim 4 in which the valve means controlling the fuel flow within the system includes a first solenoid valve in the first fuel line connecting the one end of the chamber of the main injection unit to one of the fuel injectors, a second solenoid valve in the second fuel line connecting the other end of the chamber of the main injection unit to the other fuel injector, a third solenoid valve in the third fuel line connecting the one end of the chamber of the pilot injection unit to the intensifier assembly of one of the fuel injectors, and a fourth solenoid valve in the fourth fuel line connecting the other end of the chamber of the pilot injection unit to the intensifier assembly of the other fuel injector, and control means for timing the opening and closing of the first, second third and fourth solenoid valves so that a pilot injection of fuel from the pilot injection unit occurs followed by a main injection of fuel from the main injection unit for each of the fuel injectors.

6. A fuel management system for an internal combustion engine having a pair of cylinders, said system comprising a pair of fuel injectors one for each cylinder of the internal combustion engine, a fuel source for supplying fuel under pressure to the fuel injectors, a fuel supply line connecting the fuel source with the fuel injectors, a fuel vent line for returning fuel from the injectors to the fuel source, a main injection unit operatively connected to each of said fuel injectors to supply fuel to said injectors, said main injection unit having a chamber extending along an axis from one end of the unit to another end of the unit for receiving fuel under pressure from said fuel supply line, a main fuel line connecting the chamber of the main injection unit to the fuel supply line, a main injection piston having a first side and a second side axially moveable within the chamber from one end of the chamber to the other end of the chamber, the main injection piston being freely moveable within the chamber according to fuel pressure applied to one of the sides of the main injection piston, the volume of the chamber not occupied by the main injection piston defining a predetermined volume of fuel to be introduced into one or the other of the fuel injectors, a first fuel line connecting the one end of the chamber of the main injection unit to one of the fuel injectors and a second fuel line connecting the other end of the chamber of the main injection unit to the other fuel injector, and valve means controlling the fuel flow within the system so that the predetermined volume of fuel is introduced first into one of the injectors when the main injection piston moves to one end of the chamber and then a predetermined volume of fuel is introduced into the other of the injectors when the main injection piston moves to the other end of the chamber.

7. The fuel management system of claim 6 in which the fuel injectors each have an intensifier assembly, each intensifier assembly having an upper chamber and a lower chamber, the upper chamber being of greater diameter than the lower chamber, an intensifier piston having an upper portion moveable in said upper chamber and a lower portion moveable in said lower chamber, the upper portion having a top surface of greater diameter than the bottom surface of the lower portion, the first fuel line connecting the one end of the chamber of the main injection unit to one of the fuel injectors connects to the lower chamber of the intensifier assembly below the bottom surface of the lower portion of the intensifier piston, and the second fuel line connecting the other end of the chamber of the main injection unit to other of the fuel injectors connects to the lower chamber of the intensifier assembly below the bottom surface of the lower portion of the intensifier piston, the upper chamber of the intensifier assembly of each of the fuel injectors being connected to the fuel supply line.

8. The fuel management system of claim 7 in which there is a pilot injection unit operatively connected to the intensifier assembly of each of said fuel injectors, said pilot injection unit having a chamber extending along an axis from one end of the pilot injection unit to another end of the pilot injection unit for receiving fuel under pressure from said fuel supply line, a pilot fuel line connecting the chamber of the pilot injection unit to the fuel supply line, a pilot injection piston having a first side and a second side axially moveable within the chamber from one end of the chamber to the other end of the chamber, the pilot injection piston being freely moveable within the chamber according to fuel pressure applied to one of the sides of the pilot injection piston, the volume of the chamber of the pilot injection unit not occupied by the pilot injection piston defining a predetermined volume of fuel to be introduced into the intensifier assembly of one or the other of the fuel injectors, a third fuel line connecting the one end of the chamber of the pilot injection unit to the intensifier assembly of one of the fuel injectors and a fourth fuel line connecting the other end of the chamber of the pilot injection unit to the intensifier assembly of the other fuel injector, and valve means controlling the fuel flow within the system so that the predetermined volume of fuel in the chamber of the pilot injection unit is introduced first into the upper chamber of the intensifier assembly of one of the injectors when the pilot injection piston moves to one end of the chamber and then the predetermined volume of fuel in the chamber of the pilot injection unit is introduced into the intensifier assembly of the other of the injectors when the pilot injection piston moves to the other end of the chamber of the pilot injection unit

9. The fuel management system of claim 8 in which the third fuel line connecting the one end of the chamber of the pilot injection unit to the intensifier assembly of one of the fuel injectors connects to the upper chamber of the intensifier assembly, and the fourth fuel line connecting the other end of the chamber of the pilot injection unit to the intensifier assembly of the other one of the fuel injectors connects to the upper chamber of the intensifier assembly.

10. The fuel management system of claim 9 in which the valve means controlling the fuel flow within the system includes a first solenoid valve in the first fuel line connecting the one end of the chamber of the main injection unit to one of the fuel injectors, a second solenoid valve in the second fuel line connecting the other end of the chamber of the main injection unit to the other fuel injector, a third solenoid valve in the third fuel line connecting the one end of the chamber of the pilot injection unit to the intensifier assembly of one of the fuel injectors, and a fourth solenoid valve in the fourth fuel line connecting the other end of the chamber of the pilot injection unit to the intensifier assembly of the other fuel injector, and control means for timing the opening and closing of the first, second third and fourth solenoid valves so that a pilot injection of fuel from the pilot injection unit occurs followed by a main injection of fuel from the main injection unit for each of the fuel injectors.

* * * * *